United States Patent [19]

Steiro

[11] 4,039,642

[45] Aug. 2, 1977

[54] METHOD OF MAKING CONCRETE PIPE

[76] Inventor: Harry Steiro, P.O. Box H, Woodruff, Wis. 54568

[21] Appl. No.: 615,802

[22] Filed: Sept. 22, 1975

Related U.S. Application Data

[60] Division of Ser. No. 429,562, Jan. 2, 1974, abandoned, which is a continuation of Ser. No. 616,502, Sept. 24, 1975.

[51] Int. Cl.[2] ..... B28B 1/08

[52] U.S. Cl. ..... 264/71; 264/336

[58] Field of Search ..... 425/262, 427; 264/71, 264/72, 312, 336, 334

[56] References Cited

U.S. PATENT DOCUMENTS 2,356,852 8/1944 Hutchinson ..... 264/72

2,404,464 7/1946 Sewell ..... 425/262

*Primary Examiner*—Thomas P. Pavelko

*Attorney, Agent, or Firm*—James E. Nilles

[57] ABSTRACT

A method for forming large concrete pipes of no-slump concrete and in which the inner and outer concrete molds are horizontally disposed and the annular space therebetween is filled with no-slump concrete through a longitudinal opening in the outer mold. The inner mold is withdrawn axially in generally horizontal direction from the outer mold immediately after the pour has been made. The outer mold together with the wet pipe therein can then be immediately swung to a vertical position so the pipe on its end pallet can set on support legs and the outer mold is then immediately axially stripped upwardly from the finished pipe.

1 Claim, 12 Drawing Figures

FIG. 4
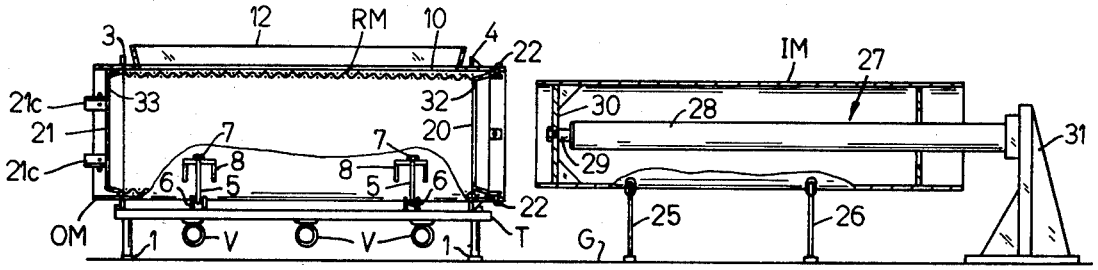
FIG. 5
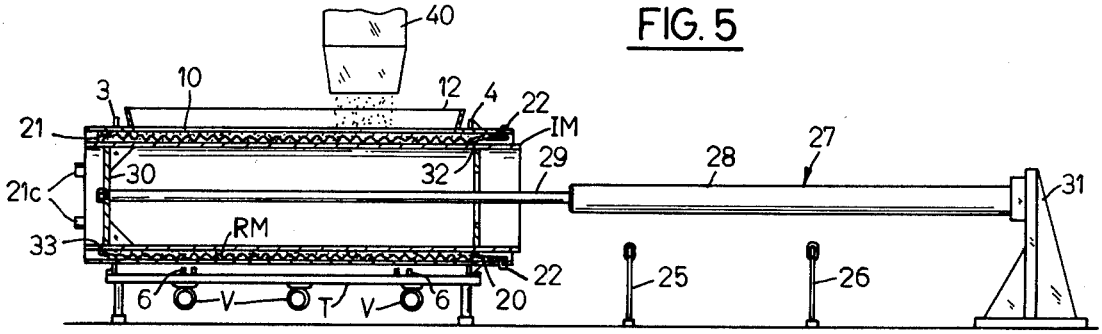
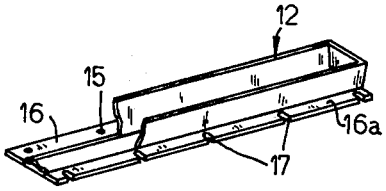
FIG. 6a
FIG. 6
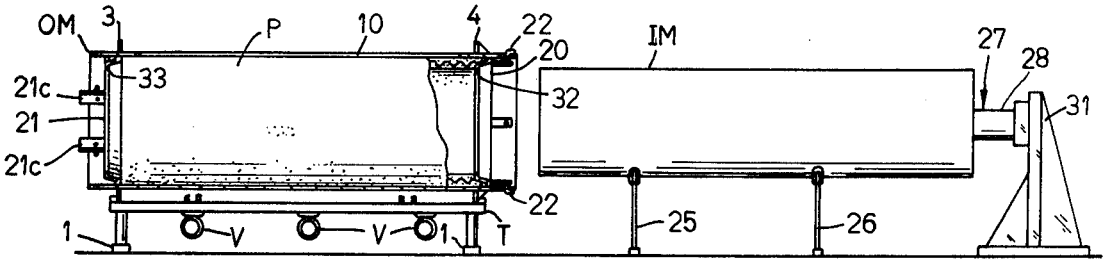

FIG. 7
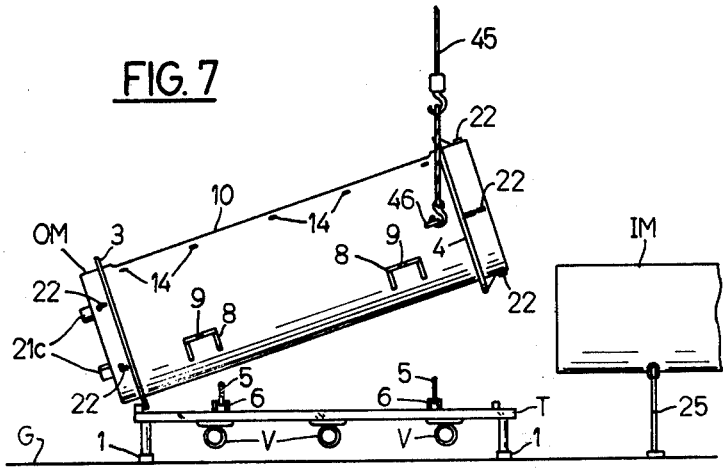
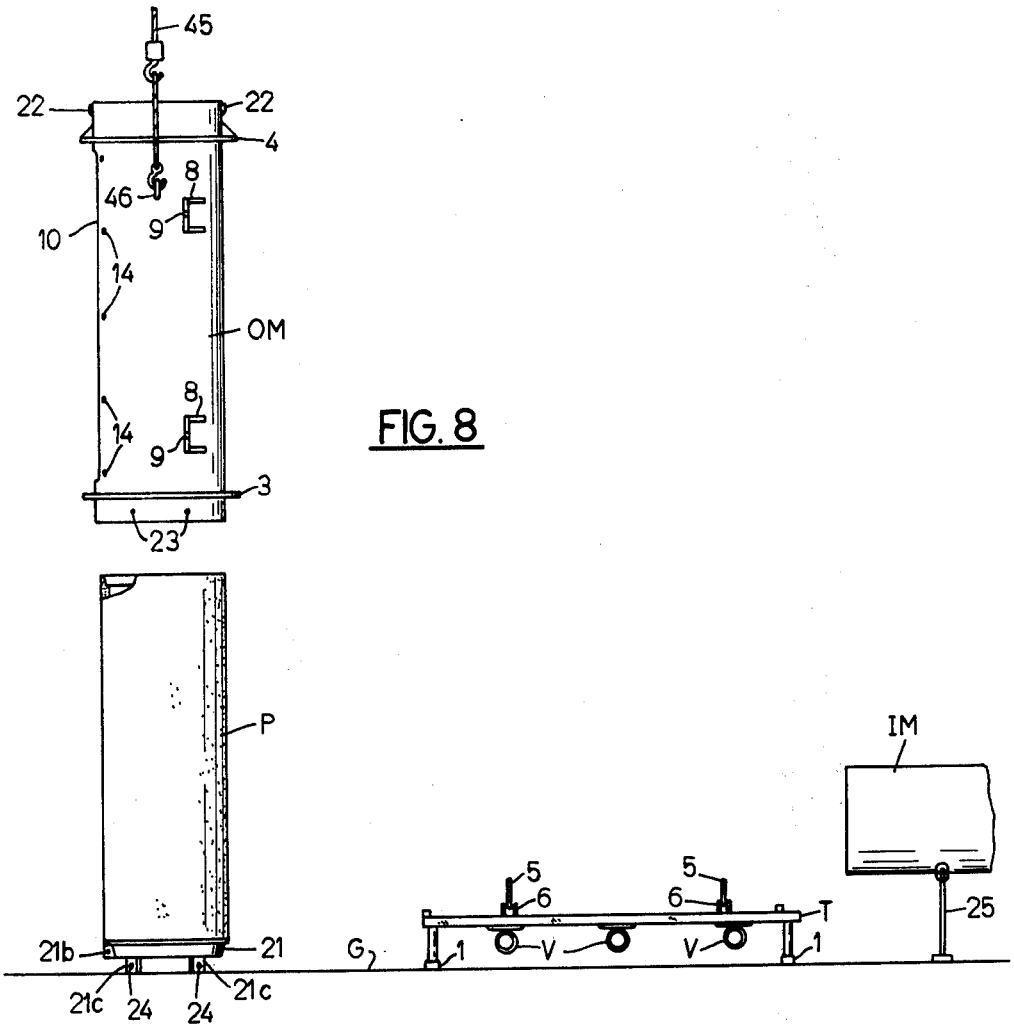
FIG. 8

METHOD OF MAKING CONCRETE PIPE

REFERENCE TO RELATED CO-PENDING APPLICATION

This is a divisional patent application from my co-pending patent application Ser. No. 429,562, filed Jan. 2, 1974, and entitled and which is now a continuation application Ser. No. 616,502 filed Sept. 24, 1975. "Method and Apparatus for Making Concrete Pipes and now abandoned."

BACKGROUND OF THE INVENTION

This invention pertains to making a particularly large concrete pipe, for example of the type having male and female ends. Examples of prior art types of apparatus over which the present invention is an improvement are shown in the U.S. Pats. No. 3,047,929 issued Aug. 7, 1962; 3,141,222 issued July 21,1964; and 3,334,390 issued Aug. 8, 1967.

SUMMARY OF THE INVVENTION

The present invention provides a method of making concrete pipe from no-slump concrete in which inner and outer concentric molds are arranged horizontally and wherein the no-slump concrete is introduced through a longitudinal slot or opening in the upper side of the horizontally disposed outer mold. Prior to the pouring of the no-slump concrete into the molds, an end ring is accurately fixed between each of the ends of the inner and outer mold so as to precisely locate the inner and outer molds relative to one another and thereby insure uniform wall thickness of the finished pipe. Vibrators are provided for the supporting table of the mold to enhance the placement of the no-slump concrete. Immediately after the pour has been made and the concrete has been compacted, the inner mold is withdrawn from the compacted wet pipe in a horizontal direction. Then the outer mold can be immediately swung to a vertical position and stripped from the wet pipe in a vertically upward direction thereby exposing the wet pipe on its supporting surface and on the end ring at the bottom of the pipe.

These and other objects and advantages of the present invention wll appear hereinafter as this disclosure progresses, reference being had to the accompanying drawings.

BRIEF DESCRIPTION OF THE DRAWINGS

FIG. 4 is a view similar to FIG. 1, but showing the cylindrical reinforced wire mesh located in the outer mold;

FIG. 5 is a view similar to FIG. 4, but showing the inner mold located within the outer mold and no slump concrete being poured into the annular space therebetween;

FIG. 6 is a view similar to FIG. 5, but showing the arrangement after the pour has been made and the inner mold axially withdrawn in a horizontal direction;

FIG. 6*a* is a perspective view of the trough which is removably secured to the top of the outer mold, a portion of the trough being shown as broken away for the sake of clarity;

FIG. 7 is a view similar to FIG. 6, but showing the outer mold with the wet pipe therein being elevated to the vertical position;

FIG. 8 shows the pipe standing on its end ring in the vertical direction and the outer mold having been axially stripped therefrom in a vertical direction.

DESCRIPTION OF A PREFERRED EMBODIMENT

Figure 1:
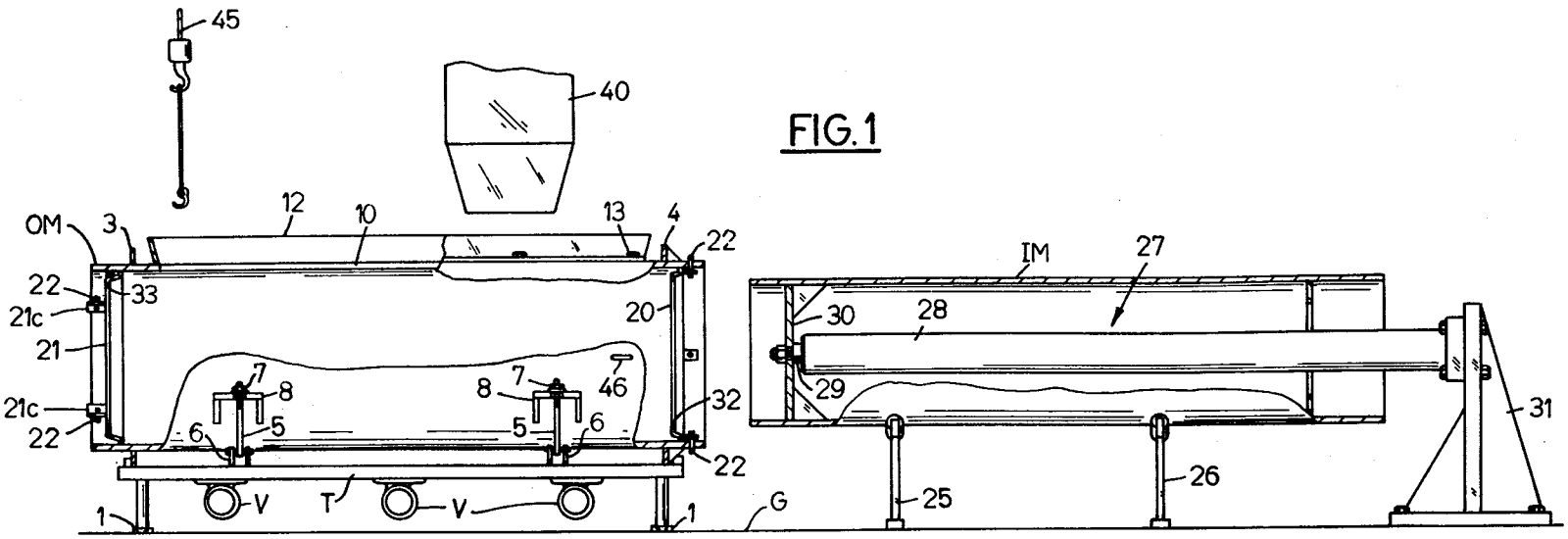
FIG. 1 is an elevational view of a concrete pipe making apparatus used with the present invention, certain parts being shown as broken away or in section for the sake of clarity in the drawings.
Figure 2:
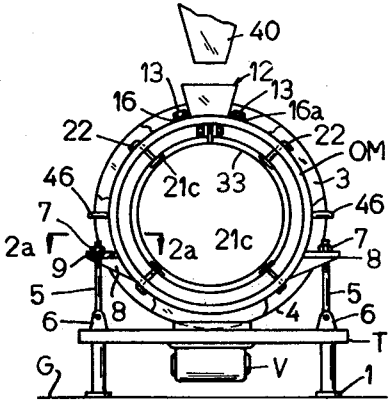
FIG. 2 is a transverse sectional view showing the end of the outer mold.
Figure 2A:
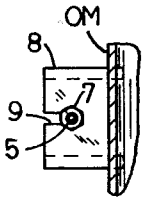
FIG. 2*a* is a sectional view taken along the line 2—2*a* in FIG. 2, but on an enlarged scale.

The apparatus chosen for illustrating the present invention includes a horizontal support table T having vibration isolating pads 1 between the table legs and the ground G or other support surface so that the vibrators V which are fixed to the underside of the table more effeciently transmit their vibrations to the pipe apparatus, as will appear. The table includes means for horizontally supporting the outer mold OM on its outer form rings 3 and 4, and this means includes means for detachably but rigidly holding the outer mold OM in position such as the threaded rod members 5 which are pivotally mounted at one of their ends on brackets 6 fixed to the table and other ends are threaded to receive nuts 7. The outer mold has a pair of brackets 8 along each side and which are alignable with the swingable arms 5. These brackets have open ended slots 9 (FIG. 2a) in which the arms 5 are quickly inserted and removable. When the arms are in the position shown in FIG. 1, the nuts 7 are tightened so as to securely hold the mold in place. When it is desired to remove the outer mold, the nuts 7 are loosened and the arms 5 are swung outwardly from the open slotted brackets 8.

The outer mold OM also has a concrete filling access means in the form of opening 10 along its top side and which extends longitudinally along the length of the outer mold. A quick removable trough 12 is secured by bolt means 13 and in alignment with the opening 10 so as to guide the no-slump concrete into the outer mold, as will appear. Bolts 13 extend through holes 14 in the cylindrical mold OM and also through aligned holes 15 along one of the trough flanges 16. Other bolts 13 extend through open ended slots 17 along the other flange 16a of the trough. Thus, the trough can be quickly removed from and replaced on the mold.

Figure 3B:
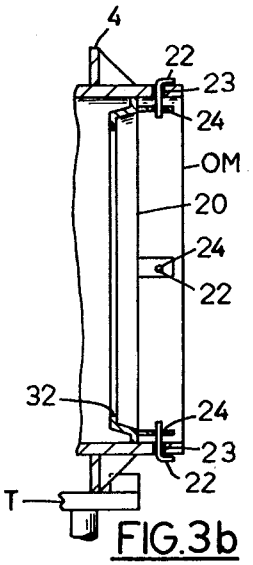
FIG. 3*b* is a fragmentary, sectional view, on an enlarged scale of one end of the outer mold and its end ring.
Figure 3:
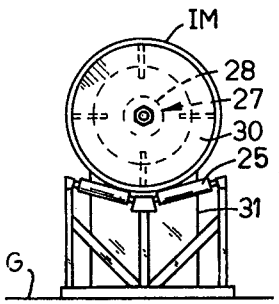
FIG. 3 is a transverse elevational view showing the end of the inner mold.
Figure 3A:
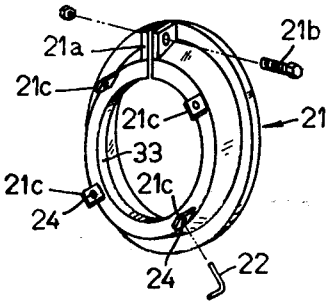
FIG. 3*a* is a perspective view of one of the end rings shown in FIG. 1.

A pair of pipe forming end rings 20 and 21 are located at opposite ends of the outer mold and are detachably held in accurate position by means of pins 22 which extend through holes 23 in the outer mold OM and into aligned holes 24 in the end rings. The arrangement is such that the end rings can be positioned, that is in a normal direction to the axis of the outer mold. As shown clearly in FIG. 3*a*, the end ring 21 has a single split 21*a* therein and by tightening the bolt means 21*b*, the ring can be contracted for easy removal.

The apparatus also includes an inner mold IM which is slideably mounted on roller stands 25 and 26 and in which is located a long hydraulic cylinder assembly 27 including the cylinder 28 and its piston 29. The outermost end of the piston rod 29 is secured to a plate member 30 fastened within the inner mold IM while the opposite end of the cylinder 28 is secured to a rigid mounting 31. The cylinder assembly 27 is of the double acting type so that pressure fluid can be admitted to either end of the cylinder to cause the inner mold to be withdrawn to the position shown in FIG. 1 or to be inserted in the outer mold as shown in FIG. 5.

The inner mold IM slides snugly in the large central aperture 32 of the end ring 20 and also slides snugly within the aperture 33 of the end ring 20, thereby effecting a seal between the end rings and the inner mold. If a reinforcing mesh RM is to be used in forming a concrete pipe with the present apparatus, the mesh is first inserted in the outer mold, as shown in FIG. 4. The inner mold is then inserted by the hydraulic cylinder assembly 27 and by shifting in a horizontal direction into the outer mold. The end rings 20 and 21 which are secured in place in the outer mold OM, accurately locate the inner mold IM and insure an even wall thickness around the entire pipe P to be made, and the inner mold IM is easily inserted into and withdrawn from the outer mold OM.

When the inner mold is in place, no-slump concrete (FIG. 5) is introduced through the opening 10 formed along the length of the upper side of the outer mold. The concrete is dumped in place by a travelling hopper 40 from an overhead crane or the like (not shown).

While the concrete is being dumped between the inner and outer molds, the vibrators V impart a vigorous vibratory motion directly to the molds which compactly places the no-slump concrete. Due to the horizontal dispositon of the molds, rather than being vertically arranged, the vibrators act with particular efficiency because the concrete is being placed along a larger horizontal surface than would otherwise be possible in vertically arranged molds.

Immediately after the molds have been filled, the hopper 12 can be removed, and the concrete along the opening 10 is struck off flush with the inside of the outer mold. The inner mold IM is then immediately withdrawn in a horizontal direction and out of the outer mold, by means of the hydraulic cylinder assembly 27. Immediately following, the outer mold OM together with the pipe therein can be raised by a power means such as an overhead sling 45 attached to eyelets 46 on each side of the mold, so that the pipe P (FIG. 8) rests on the legs 21*c* of its end ring 21. The pins 22 are then withdrawn from between the outer mold OM and the end ring 21, and the outer mold OM is then immediately stripped vertically upwardly from the pipe P.

The stripped pipe can then be immediately removed from the area and permitted to cure.

The present invention provides a method for efficiently accurately, and rapidly forming large concrete pipes at good production rates.

I claim:

1. The method of making concrete pipe in the horizontal position from no-slump concrete, said method comprising the steps of horizontally positioning and securing an outer mold on a table, securing end rings having openings therein near opposite ends of said outer mold, axially shifting a horizontally positioned cylindrical inner mold in a horizontal direction so as to insert said inner mold into said outer mold and through said openings in said end rings and in concentric relationship therewith, maintaining said inner and outer molds in said concentric relationship, dumping no-slump concrete through a longitudinal opening in the upper side of said outer mold and thereby filling the annular chamber between said molds, vibrating said table to effect vibration of said molds during said filling to thereby compactly place said no-slump concrete therebetween in the form of a wet pipe, then immediately axially withdrawing said inner mold in a generally horizontal direction from said outer mold and from said openings in said end rings, then immediately detaching said outer mold from said table, then immediately raising said outer mold and said wet pipe therein to a vertical position, then immedately setting the lower end of said wet pipe on one of its end rings and releasing said one end ring from said outer mold, and then immediately vertically stripping said outer mold from said wet pipe, axially sliding said outer mold from said wet pipe along the entire length thereof leaving said pipe on said end ring.

* * * * *